US010013920B2

(12) United States Patent
Oh et al.

(10) Patent No.: US 10,013,920 B2
(45) Date of Patent: Jul. 3, 2018

(54) DISPLAY DEVICE AND MODULE AND METHOD FOR COMPENSATING PIXELS OF DISPLAY DEVICE

(71) Applicant: LG DISPLAY CO., LTD., Seoul (KR)

(72) Inventors: Jinyoung Oh, Paju-si (KR); Yeonshim Shim, Paju-si (KR); Jihoon Park, Paju-si (KR); Jeisung Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 15/385,247

(22) Filed: Dec. 20, 2016

(65) Prior Publication Data

US 2017/0345377 A1 Nov. 30, 2017

(30) Foreign Application Priority Data

May 31, 2016 (KR) ..... 10-2016-0067027

(51) Int. Cl.

*G09G 5/10* (2006.01)
*G09G 3/3291* (2016.01)
*G09G 3/3208* (2016.01)

(52) U.S. Cl.

CPC ..... *G09G 3/3291* (2013.01); *G09G 3/3208* (2013.01); *G09G 2320/0233* (2013.01); *G09G 2320/0285* (2013.01); *G09G 2320/0295* (2013.01); *G09G 2320/043* (2013.01); *G09G 2320/046* (2013.01); *G09G 2320/0613* (2013.01); *G09G 2320/0686* (2013.01); *G09G 2330/021* (2013.01)

(58) Field of Classification Search

CPC ..... G09G 3/3291; G09G 3/3208; G09G 2320/0233; G09G 2320/0285; G09G 2320/0295; G09G 2320/043; G09G 2320/046; G09G 2320/0613; G09G 2320/0585; G09G 2330/021

See application file for complete search history.

(56) References Cited

U.S. PATENT DOCUMENTS

| | | | |
|---|---|---|---|
| 2010/0007656 | A1 | 1/2010 | Okamoto et al. |
| 2010/0103198 | A1 | 4/2010 | Polak et al. |
| 2014/0160142 | A1 | 6/2014 | Lee et al. |
| 2016/0086537 | A1 | 3/2016 | Shin |

FOREIGN PATENT DOCUMENTS

| | | | |
|---|---|---|---|
| JP | 2007-286296 | A | 11/2007 |
| JP | 2009-133943 | A | 6/2009 |
| JP | 2010-020078 | A | 1/2010 |

*Primary Examiner* — Peter D McLoone

(74) *Attorney, Agent, or Firm* — Dentons US LLP

(57) ABSTRACT

A pixel compensation module according to one embodiment of the present disclosure detects a degraded region with reference to degradation data corresponding to each of pixels included in a display panel, determines a first compensation gain so as to decrease final compensation data of pixels included in the degraded region, and determines a second compensation gain so as to increase final compensation data of pixels included in an adjacent degraded region to correct compensation data of the pixels.

14 Claims, 11 Drawing Sheets

PRIOR ART

PRIOR ART

FIG. 8

MAP

| i \ j | 1 | 2 | 3 | 4 | 5 | 6 | 7 | 8 | 9 | 10 |
|---|---|---|---|---|---|---|---|---|---|---|
| 1 | 10 | 10 | 10 | 10 | 10 | 10 | 10 | 10 | 10 | 10 |
| 2 | 10 | 10 | 10 | 10 | 10 | 10 | 10 | 10 | 10 | 10 |
| 3 | 10 | 10 | 10 | 10 | 10 | 10 | 10 | 10 | 10 | 10 |
| 4 | 10 | 10 | 10 | 100 | 100 | 100 | 10 | 10 | 10 | 10 |
| 5 | 10 | 10 | 10 | 100 | 100 | 100 | 10 | 10 | 10 | 10 |
| 6 | 10 | 10 | 10 | 100 | 100 | 100 | 10 | 10 | 10 | 10 |
| 7 | 10 | 10 | 10 | 10 | 10 | 10 | 10 | 10 | 10 | 10 |
| 8 | 10 | 10 | 10 | 10 | 10 | 10 | 10 | 10 | 10 | 10 |
| 9 | 10 | 10 | 10 | 10 | 10 | 10 | 10 | 10 | 10 | 10 |
| 10 | 10 | 10 | 10 | 10 | 10 | 10 | 10 | 10 | 10 | 10 |

X-AXIS SOBEL MASK

| | | |
|---|---|---|
| 1 | 0 | −1 |
| 1 | 0 | −1 |
| 1 | 0 | −1 |

Y-AXIS SOBEL MASK

| | | |
|---|---|---|
| 1 | 1 | 1 |
| 0 | 0 | 0 |
| −1 | −1 | −1 |

FIG. 9

| i \ j | 1 | 2 | 3 | 4 | 5 | 6 | 7 | 8 | 9 | 10 |
|---|---|---|---|---|---|---|---|---|---|---|
| 1 | 0 | 0 | 0 | 0 | 0 | 0 | 0 | 0 | 0 | 0 |
| 2 | 0 | 0 | 0 | 0 | 0 | 0 | 0 | 0 | 0 | 0 |
| 3 | 0 | 0 | 20 | 30 | 30 | 30 | 20 | 0 | 0 | 0 |
| 4 | 0 | 0 | 30 | 40 | 30 | 40 | 30 | 0 | 0 | 0 |
| 5 | 0 | 0 | 30 | 30 | 0 | 30 | 30 | 0 | 0 | 0 |
| 6 | 0 | 0 | 30 | 40 | 30 | 40 | 30 | 0 | 0 | 0 |
| 7 | 0 | 0 | 20 | 30 | 30 | 30 | 20 | 0 | 0 | 0 |
| 8 | 0 | 0 | 0 | 0 | 0 | 0 | 0 | 0 | 0 | 0 |
| 9 | 0 | 0 | 0 | 0 | 0 | 0 | 0 | 0 | 0 | 0 |
| 10 | 0 | 0 | 0 | 0 | 0 | 0 | 0 | 0 | 0 | 0 |

AR1

DISPLAY DEVICE AND MODULE AND METHOD FOR COMPENSATING PIXELS OF DISPLAY DEVICE

CROSS-REFERENCE TO RELATED APPLICATIONS

This application claims the priority of Korean Patent Application No. 10-2016-0067027 filed on May 31, 2016, in the Korean Intellectual Property Office, the disclosure of which is hereby incorporated by reference in its entirety.

BACKGROUND

Technical Field

The present disclosure relates to a display device and a module and a method of driving the display device.

Description of the Related Art

As a replacement for a conventional cathode ray tube, flat panel displays include a liquid crystal display, a field emission display, a plasma display panel, an organic light-emitting diode (OLED) display, and the like.

Among these displays, an OLED used in the OLED display has high luminance and low operating voltage characteristics. Since an OLED display is self-luminous, it has a high contrast ratio. Further, it is easy to implement an ultra-thin display with an OLED display. In addition, the OLED has a response time of several micro seconds (μs) and thus is suitable for representing moving images. Further, it has a wide viewing angle and can be driven stably even at a low temperature.

Pixels each including an OLED are arranged in a matrix in the OLED display. A data voltage corresponding to image data is applied to each of the pixels to flow a driving current at the OLED so that the OLED emits light at a desired luminance. Ideally, luminance of each of the pixels is uniform when an OLED display is driven. However, luminance among the pixels may become non-uniform due to deviations in electrical characteristic among driving transistors each in the respective pixels, deviations in cell driving voltages among the pixels, deviations in deterioration among the OLEDs each in the respective pixels, etc.

In particular, deviations in deterioration of the OLEDs cause an image sticking phenomenon that degrades the image quality of the OLED display.

There has been an approach for compensating for deviations in luminance among the pixels resulted from deviations in deterioration of the OLEDs. In this approach, compensation data is determined according to a cumulative amount of image data, the image data is compensated using the determined compensation data, the compensated image data is converted into a data voltage, and the data voltage is applied to a pixel.

FIG. 1 is a diagram illustrating a configuration of a conventional degradation compensation module 10.

Referring to FIG. 1, the conventional degradation compensation module 10 includes an image alignment unit 11, a memory 12, a look-up table 13, and a degradation compensation unit 14. The image alignment unit 11 corresponds and outputs image data DATA converted from an image signal to a size and a resolution of the display panel. The memory 12 stores a cumulative amount of data per each pixel in which the image data DATA applied to each pixel is accumulated at every frame. The look-up table 13 stores an average cumulative amount of data of the cumulative amount of data and compensation data corresponding to a cumulative driving time, which are mapped to each other.

The degradation compensation unit 14 reads out a decreased amount of luminance according to the cumulative amount of data per each pixel from the look-up table 13 with reference to the look-up table 13 and the memory 12. The degradation compensation unit 14 reads out compensation data Cdata according to the decreased amount of luminance per each pixel from the look-up table 13, and outputs compensated image data DATA' by adding the compensation data Cdata to the image data DATA to each pixel. Thereafter, a data voltage corresponding to the compensated image data DATA' is applied to each pixel so that each pixel emits light with its target luminance.

FIG. 2 is a graph illustrating luminance of a pixel L1 before the image data is compensated, the compensation data Cdata for compensating the image data, and luminance of a pixel L2 after the image data is compensated.

Referring to FIGS. 1 and 2, comparing luminance L1 *a* of a pixel section AR2 in which degradation occurs before the image data is compensated with luminance L1 *b* of each of pixel sections AR1 and AR3 in which degradation does not occur, a luminance difference of c is generated. As a result, an image streaking phenomenon may be generated at a boundary between the pixel section AR2 in which degradation occurs and the pixel sections AR1 and AR3 in which degradation does not occur.

To decrease the difference in luminance, the degradation compensation unit 14 sets the compensation data Cdata to b according to the decreased amount of luminance b of the pixel section AR2 in which degradation occurs with reference to the look-up table 13 and the memory 12. Thereafter, the degradation compensation unit 14 adds the set compensation data Cdata b to the image data DATA that is to be displayed at the pixel section AR2 in which degradation occurs, thereby outputting the compensated image data DATA'.

According to such a conventional compensation method, the compensated image data DATA' is input to the pixel section AR2 in which degradation occurs so that the luminance L2 of the pixel section AR2 in which degradation occurs after the compensation is increased from a to c that is the difference in luminance before the compensation. As a result, the luminance L2 of the pixel section AR2 in which degradation occurs after the image data is compensated is the same the luminance L2 *b* of each of the pixel sections AR1 and AR3 in which degradation does not occur, such that there may be no luminance difference between the pixel section AR2 in which degradation occurs and the pixel sections AR1 and AR3 in which degradation does not occur.

However, according to such a conventional degradation compensation method, an amount of current corresponding to the compensation data Cdata flows continuously and additionally in a pixel in which degradation occurs. Because an amount of current flowing in the pixel in which degradation occurs is increased, degradation of the pixel may be accelerated as the conventional degradation compensation method is continuously performed.

SUMMARY

Accordingly, the present disclosure is directed to a display device and a module and a method of driving a display device.

An advantage of the present disclosure is to provide a display device that is capable of decreasing final compensation data of pixels included in a degraded region, and reducing a degradation degree of the pixels included in a degraded region and also preventing a lowering of image quality due to degradation by increasing final compensation data of pixels included in an adjacent degraded region.

Also, it is another advantage of the present disclosure to provide a display device and a module and a method for compensating pixels of the display device which are capable of more effectively compensating degradation by detecting a degraded region that is easily perceived by a user on the basis of a deviation between degradation data of pixels, and performing compensation for the degraded region that is detected.

In addition, it is still another advantage of the present disclosure to provide a display device and a module and a method for compensating pixels of the display device which perform compensation as necessary by determining whether correction is performed on the basis of an image characteristic constant.

Advantages of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

Conventionally, degradation of pixels on which compensation is performed may be accelerated as performing compensation by adding compensation data for compensating degradation to only the pixels at which degradation occurs to drive the pixels.

To address such a problem, a pixel compensation method according to one embodiment of the present disclosure detects a degraded region with reference to degradation data corresponding to each of pixels included in a display panel. Further, a first compensation gain for correcting compensation data of pixels included in the degraded region, and a second compensation gain for correcting compensation data of pixels included in an adjacent degraded region within a first preset distance from a peripheral pixel of the degraded region are determined. Next, the compensation data of the pixels included in the degraded region and the compensation data of the pixels included in an adjacent degraded region using the first compensation gain and the second compensation gain are corrected.

Also, a pixel compensation module according to one embodiment of the present disclosure includes a degraded region detection unit configured to detect a degraded region with reference to degradation data corresponding to each of pixels included in a display panel, a compensation gain determination unit configured to determine a first compensation gain for correcting compensation data of pixels included in the degraded region, and a second compensation gain for correcting compensation data of pixels included in an adjacent degraded region within a first preset distance from a peripheral pixel of the degraded region, and a compensation data correction unit configured to correct the compensation data of the pixels included in the degraded region and the compensation data of the pixels included in an adjacent degraded region using the first compensation gain and the second compensation gain.

Further, a display device according to one embodiment of the present disclosure includes a display panel including pixels, each of which is disposed at an interesting position of a data line and a gate line, a driving unit configured to supply a gate signal to the gate line, a timing control unit configured to control a gate driving unit and a data driving unit and generate degradation data and compensation data which correspond to each of the pixels included in the display panel, and a pixel compensation module configured to detect a degraded region with reference to the degradation data, determine a first compensation gain for correcting compensation data of pixels included in the degraded region and a second compensation gain for correcting compensation data of pixels included in an adjacent degraded region within a first preset distance from a peripheral pixel of the degraded region, and correct the compensation data of the pixels included in the degraded region and the compensation data of the pixels included in an adjacent degraded region using the first compensation gain and the second compensation gain.

Here, the timing control unit compensates for input image data using the compensation data that is corrected by means of the pixel compensation module, and supplies the compensated input image data to the data driving unit.

The degraded region and the adjacent degraded region are set with reference to the degradation data of each of the pixels. As described above, degradation of pixels corresponding to the degraded region may be accelerated due to compensation for the degraded region, but an embodiment of the present disclosure applies compensation for the adjacent degraded region instead of reducing compensation for the degraded region compared to the related art.

In accordance with such a compensation method according to an embodiment of the present disclosure, a lowering of image quality due to degradation may be prevented and also a degradation degree of the pixels included in the degraded region may be reduced, thereby extending a lifetime of the display device.

As described above, in accordance with an embodiment of the present disclosure, final compensation data of the pixels included in the degraded region is decreased and final compensation data of the pixels included in the adjacent degraded region is increased so that a lowering of image quality due to degradation may be prevented and also a degradation degree of the pixels included in the degraded region may be reduced, thereby extending a lifetime of the display device.

Also, in accordance with an embodiment of the present disclosure, a degraded region, which is easily perceived by a user, is detected on the basis of a deviation between degradation data of pixels and compensation is performed on the degraded region that is detected so that it may be possible to more effectively compensate for degradation.

Further, in accordance with an embodiment of the present disclosure, whether correction is performed on compensation data of pixels is determined on the basis of an image characteristic constant generated from input image data so that compensation may be effectively performed as necessary.

It is to be understood that both the foregoing general description and the following detailed description are exemplary and explanatory and are intended to provide further explanation of the invention as claimed.

BRIEF DESCRIPTION OF DRAWINGS

FIG. 8 is a diagram for describing a degraded region detection of a degraded region detection unit according to one embodiment.

FIG. 9 is a diagram illustrating a degraded region detected from the degraded region detection unit according to one embodiment.

DETAILED DESCRIPTION OF THE ILLUSTRATED EMBODIMENTS

Figure 1:
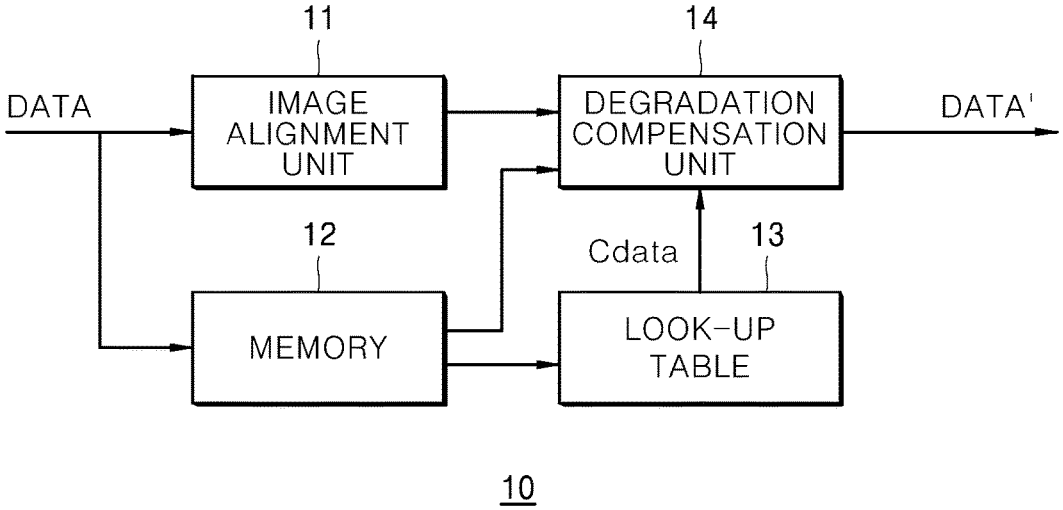
FIG. 1 is a diagram illustrating a configuration of a conventional degradation compensation module.

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well-known functions or configurations may be omitted in order not to unnecessarily obscure the gist of the present disclosure.

Hereinafter, embodiments of the present disclosure will be described in detail with reference to the accompanying drawings. Throughout the drawings, like reference numerals refer to like elements.

Figure 3:
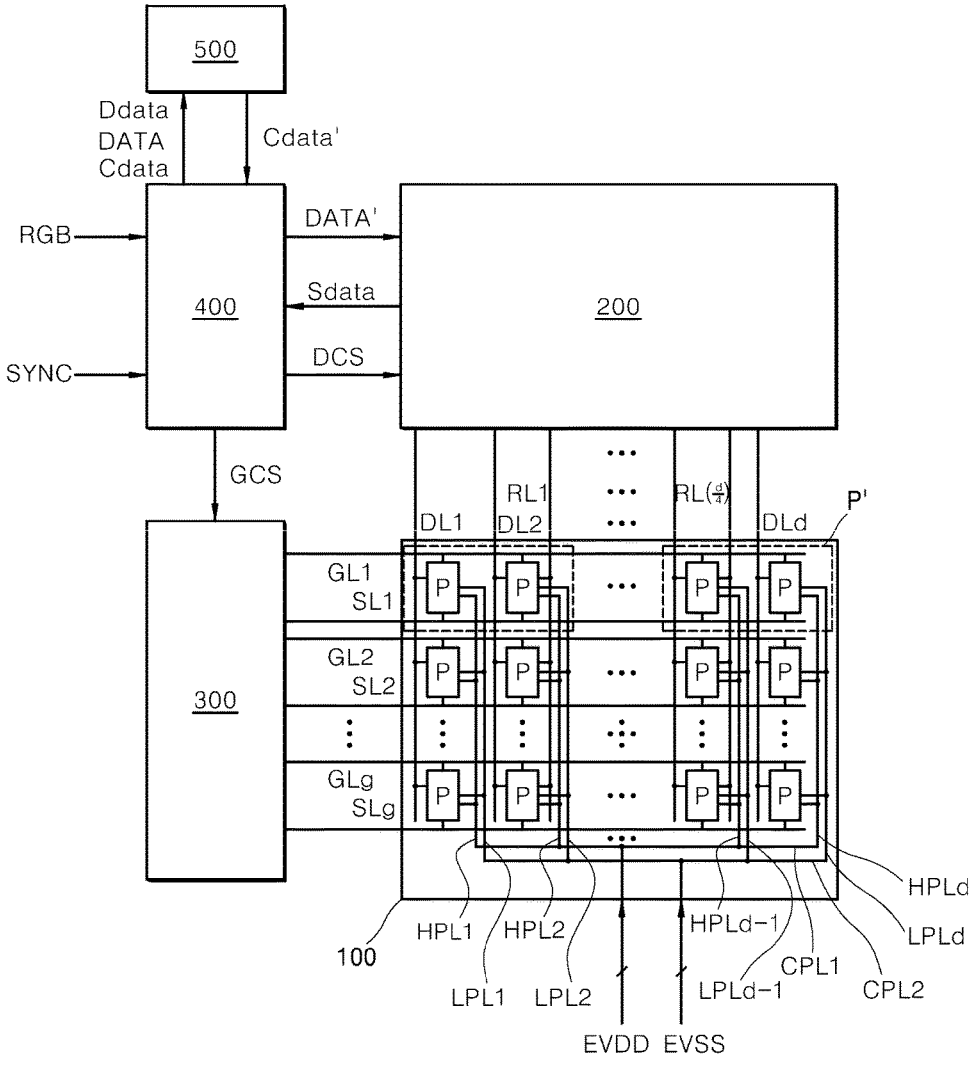
FIG. 3 is a diagram schematically illustrating a configuration of a display device according to one embodiment of the present disclosure.

FIG. 3 is a diagram schematically illustrating a configuration of a display device 1000 according to one embodiment of the present disclosure.

Referring to FIG. 3, the display device 1000 according to one embodiment of the present disclosure may be configured to include a display panel 100, a data driving unit 200, a gate driving unit 300, a timing control unit 400, and a pixel compensation module 500.

The display panel 100 includes pixels P, each of which is configured with an OLED, and a reference voltage line RL is formed at unit pixels P', each of which is formed with at least three pixels P, and connected to the data driving unit 200.

Also, signal lines are formed at the display panel 100 to define a pixel region in which the pixels P are formed and to control driving of the pixels P.

Such signal lines may be configured to include first to $g^{th}$ (herein, g is a natural number) gate lines GL1 to GLg, first to $g^{th}$ sensing lines SL1 to SLg, first to $d^{th}$ (herein, d is a natural number greater than g) data lines DL1 to DLd, first to $d/4^{th}$ reference voltage lines RL1 to RL(d/4), a plurality of high potential driving voltage lines HPL1 to HPLd, and at least one low potential driving voltage lines LPL1 to LPLd.

A single unit pixel P' is configured with three or four pixels P. In particular, four pixels (that is, a red pixel R, a white pixel W, a green pixel G, and a blue pixel B) form a single unit pixel P', and the reference voltage line RL is formed at the single unit pixel P'.

The data driving unit 200 transmits sensing data Sdata, which is sensed from the pixels P, to the timing control unit 400, and delivers compensated input image data DATA', which is received from the timing control unit 400, to the pixels P according to a data control signal DCS.

The gate driving unit 300 receives a gate control signal GCS from the timing control unit 400 to control switching of a transistor included in each of the pixels P.

The timing control unit 400 converts an input image RGB into input image data DATA, and also converts the input image data DATA into the compensated input image data DATA' based on final compensation data Cdata', which is received from the pixel compensation module 500.

Also, the timing control unit 400 receives and stores the sensing data Sdata as degradation data Ddata, and transmits the degradation data Ddata to the pixel compensation module 500.

The pixel compensation module 500 converts the compensation data Cdata received from the timing control unit 400 into the final compensation data Cdata', which is corrected, to transmit the final compensation data Cdata' to the timing control unit 400. To correct the final compensation data Cdata', the pixel compensation module 500 detects a degraded region on the display panel 100 and an adjacent degraded region thereon on the basis of the degradation data Ddata. Thereafter, the pixel compensation module 500 differently corrects compensation data for the degraded region from compensation data for the adjacent degraded region.

In one embodiment of the present disclosure, the pixel compensation module 500 receives the input image data DATA to generate an image characteristic constant. The pixel compensation module 500 determines a minimum value of the final compensation data Cdata' of pixels included in the degraded region, or a maximum value of the final compensation data Cdata' of pixels included in the adjacent degraded region on the basis of the generated image characteristic constant.

A process in which the above described pixel compensation module 500 detects the degraded region and the adjacent degraded region and corrects the compensation data will be described in detail with reference to FIG. 7.

Hereinafter, a configuration and an operation of a pixel P will be described with reference to FIG. 4.

Figure 4:
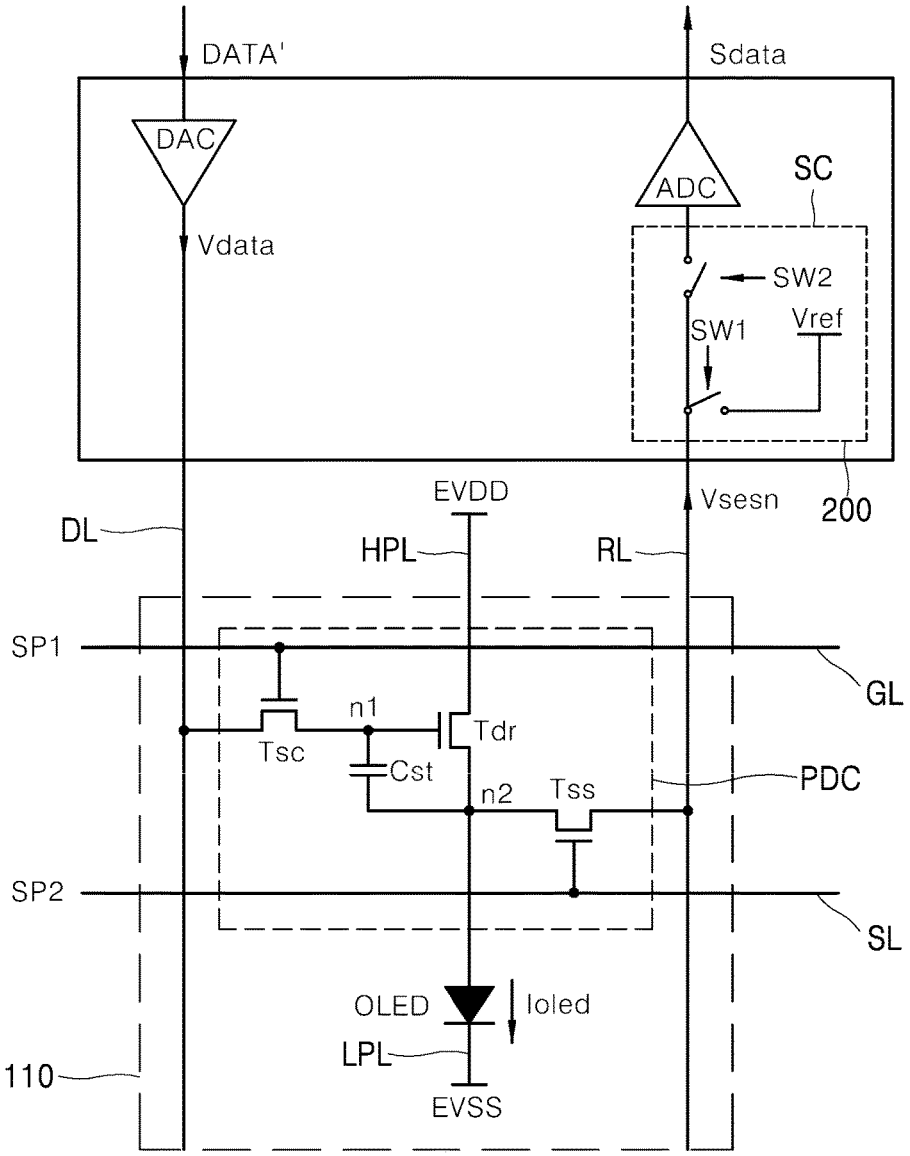
FIG. 4 is a diagram illustrating configurations of a pixel and a data driving unit of the display device according to one embodiment of the present disclosure.

FIG. 4 is a diagram illustrating configurations of a pixel P and the data driving unit 200 of the display device 1000 according to one embodiment of the present disclosure.

Referring to FIG. 4, the pixel P may be configured to include a pixel driving circuit PDC and an organic light-emitting diode.

The pixel driving circuit PDC includes a scan transistor Tsc, a sensing transistor Tss, a driving transistor Tdr, and a storage capacitor Cst.

The pixel P may be driven in a driving mode for emitting light corresponding to a data voltage Vdata and a sensing mode for sensing electrical characteristics (that is, a threshold voltage and electron mobility) of the driving transistor Tdr according to control signals of the transistors Tsc, Tss, and Tdr, which are input through signal lines.

Firstly, a driving mode of the pixel will be described.

In a driving mode, the data driving unit 200 converts compensated digital data DATA', which is received from the timing control unit 400 according to a data control signal DCS of the driving mode, into a data voltage Vdata and supplies the data voltage Vdata to a corresponding data line DL.

For this purpose, the data driving unit 200 converts the compensated digital data DATA' received from the timing control unit 400 into the data voltage Vdata using a digital-analog converter DAC.

The scan transistor Tsc is turned on in response to a first scan pulse SP1 to output the data voltage Vdata to the data line DL.

The sensing transistor Tss is turned on in response to a second scan pulse SP2 to supply a reference voltage Vref, which is supplied to a reference voltage line RL, to a second node n2 that is a source terminal of the driving transistor Tdr.

The storage capacitor Cst charges a differential voltage between voltages respectively supplied to a first node n1 and the second node n2 according to a switching of each of the scan transistor Tsc and the sensing transistor Tss.

Thereafter, the driving transistor Tdr is turned on according to the voltage charged at the storage capacitor Cst, and the scan transistor Tsc and the sensing transistor Tss are turned off in response to the first scan pulse SP1 and the second scan pulse SP2, respectively.

The driving transistor Tdr is turned on by means of the voltage of the storage capacitor Cst to supply a driving current Ioled to the organic light-emitting diode OLED.

The organic light-emitting diode OLED emits light by means of the driving current Ioled supplied from the driving transistor Tdr and discharges monochrome light having luminance corresponding to the driving current Ioled.

Next, a sensing mode of the pixel P will be described.

In a sensing mode, the scan transistor Tsc is turned off in response to the first scan pulse SP1. As a result, the data voltage Vdata is not supplied to a gate terminal of the driving transistor Tdr.

The sensing transistor Tss is turned on in response to the second scan pulse SP2 to supply a sensing voltage Vsen to the data driving unit 200 through the reference voltage line RL. Thereafter, the sensing voltage Vsen is converted into sensing data Sdata through the data driving unit 200 and the sensing data Sdata is transmitted to the timing control unit 400.

A sensing circuit SC may include a pre-charging switch SW1 which is controlled in an ON or OFF state based on the data control signal DCS to supply the reference voltage Vref to a source terminal of the sensing transistor Tss, and a sampling switch SW2 which connects a connection between the sensing line SL and an analog-digital converter ADC or blocks the connection therebetween.

Also, in the sensing mode, the data driving unit 200 may control the sampling switch SW2 in an ON state and input the sensing voltage Vsen, which is transmitted from the first to $d/4^{th}$ sensing lines SL1 to SL(d/4), to the analog-digital converter ADC to convert the sensing voltage Vsen into a digital form, thereby generating the sensing data Sdata.

Figure 2:
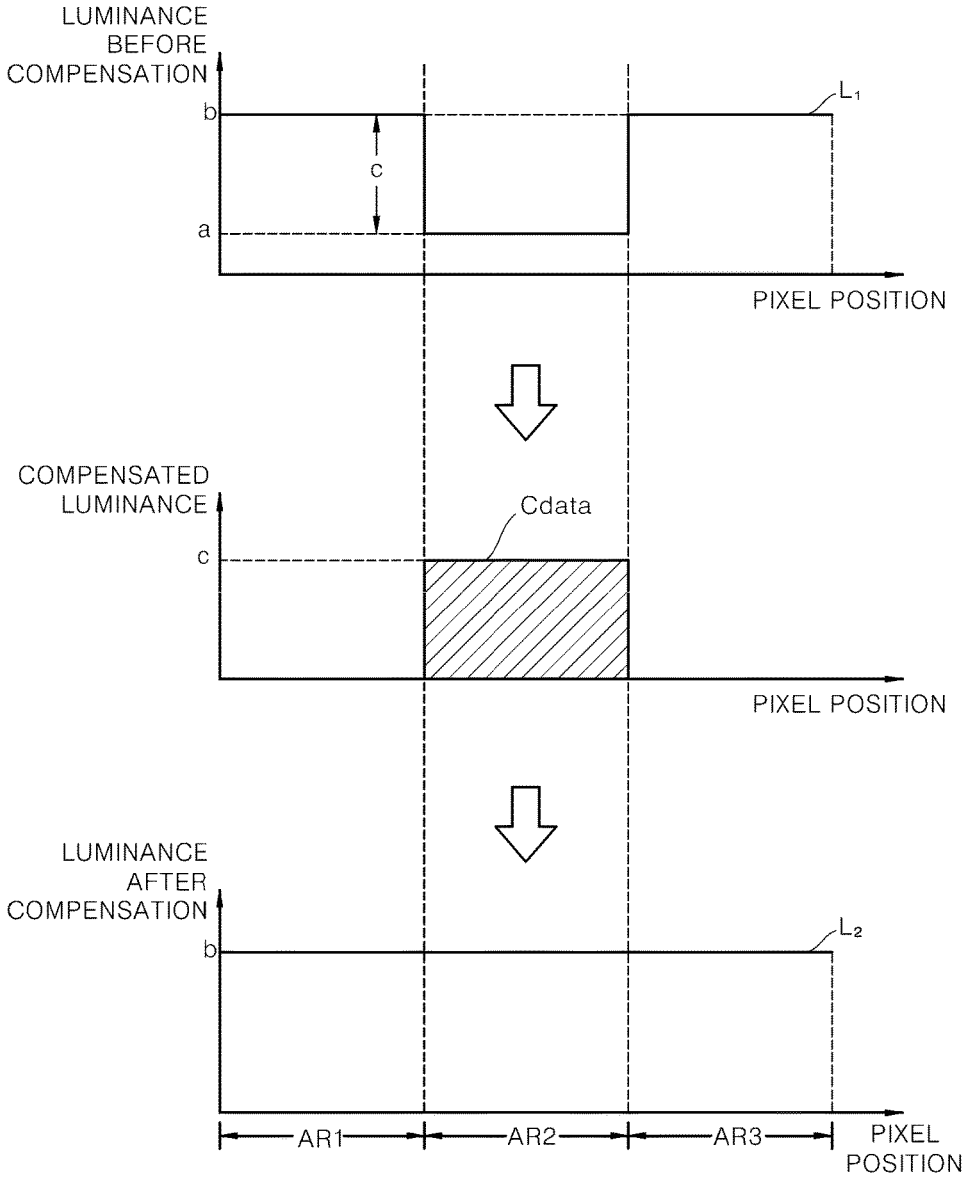
FIG. 2 is a graph illustrating luminance of a pixel before image data is compensated, compensation data for compensating the image data, and luminance of the pixel after the image data is compensated.

Hereinafter, a detailed configuration and function of the timing control unit 400 of FIG. 2 will be described with reference to FIG. 5.

Figure 5:
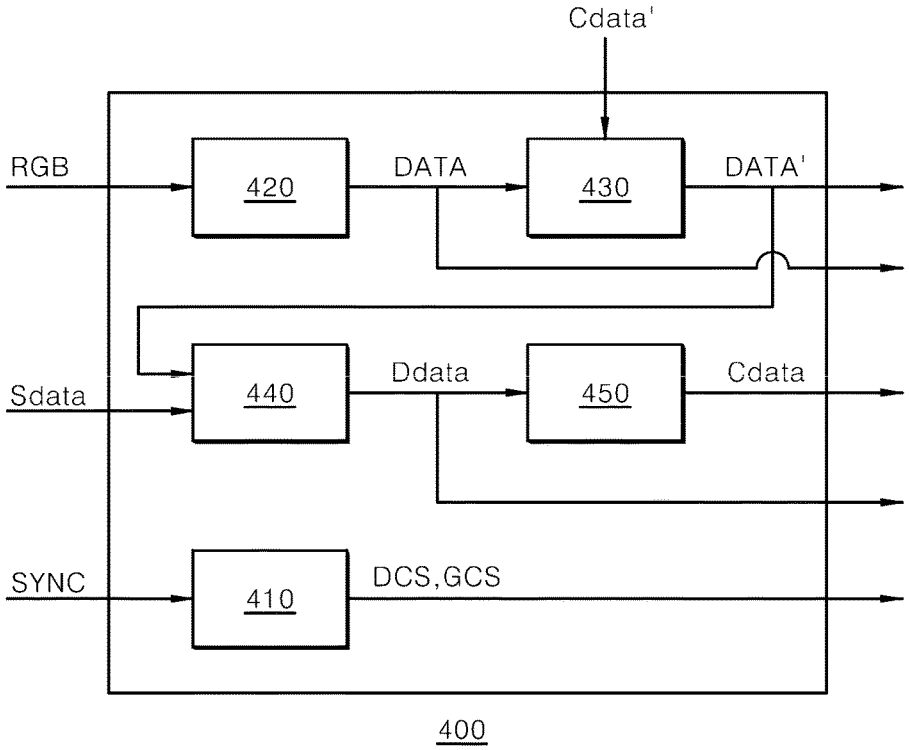
FIG. 5 is a diagram illustrating a configuration of a timing control unit and a data flow between components of the timing control unit according to one embodiment of the present disclosure.

FIG. 5 is a diagram illustrating a configuration of the timing control unit 400 and a data flow between components of the timing control unit 400 according to one embodiment of the present disclosure.

Referring to FIG. 5, the timing control unit 400 includes a signal control unit 410, a data conversion unit 420, a data compensation unit 430, a degradation data storing unit 440, and a compensation data generation unit 450.

The signal control unit 410 outputs a plurality of control signals GCS and DCS using synchronous signals SYNC that are input from the outside. Here, the plurality of control signals GCS and DCS include the gate control signal GCS and the data control signal DCS. The data control signal DCS is a signal for controlling the data driving unit 200, and the gate control signal GCS is a signal for controlling the gate driving unit 300. The synchronous signals SYNC include one or more of a dot clock DCLK, data enable signal DE, a horizontal synchronous signal Hsync, and a vertical synchronous signal Vsync.

The data conversion unit 420 converts the image signal RGB received from the outside into the input image data DATA so as to input the input image data DATA to the data driving unit 200.

The data compensation unit 430 adds the final compensation data Cdata', which is generated from the compensation data generation unit 450 that will be described and is corrected through the pixel compensation module 500, to the input image data DATA, thereby generating the compensated input image data DATA'.

The degradation data storing unit 440 stores the sensing data Sdata, which is sensed per pixel P in the sensing mode, as the degradation data Ddata.

Also, the degradation data storing unit 440 may store a cumulative amount of data per pixel, which is produced by accumulating the compensated input image data DATA' being input to the data driving unit 200 at every frame.

The compensation data generation unit 450 determines a luminance compensation value from a luminance curve according to a difference in value between a reference sensing data and the sensing data Sdata when data stored as the degradation data Ddata is the sensing data Sdata, and generates the compensation data Cdata.

When data stored as the degradation data Ddata is a cumulative amount of data per pixel, the compensation data generation unit 450 determines a luminance compensation value from a look-up table with respect to a luminance value according to the pre-stored cumulative amount of data per pixel, and then generates the compensation data Cdata.

Meanwhile, although the compensation data generation unit 450 has been described to generate the compensation data Cdata only when the degradation data Ddata is the sensing data Sdata or the cumulative amount of data per pixel, any type of degradation data Ddata may be used when the degradation data Ddata is a numerical value representing a degree of degradation of a pixel in addition to the sensing data Sdata and the cumulative amount of data per pixel.

Hereinafter, the pixel compensation module 500 according to one embodiment of the present disclosure will be described in detail with reference to FIG. 6.

Figure 6:
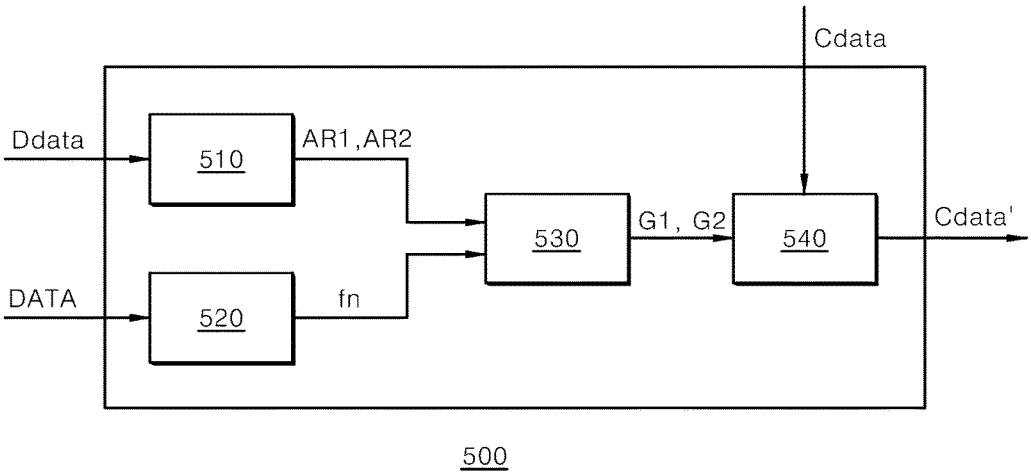
FIG. 6 is a diagram illustrating a configuration of a pixel compensation module and a data flow between components of the pixel compensation module according to one embodiment of the present disclosure.

FIG. 6 is a diagram illustrating a configuration of the pixel compensation module 500 and a data flow between components of the pixel compensation module 500 according to one embodiment of the present disclosure.

Referring to FIG. 6, the pixel compensation module 500 according to one embodiment of the present disclosure may be configured to include a degraded region detection unit 510, an image characteristic constant generation unit 520, a compensation gain determination unit 530, and a compensation data correction unit 540.

The degraded region detection unit 510 generates a degradation map MAP of the display panel 100 on the basis of the degradation data Ddata per each pixel, which is received from the timing control unit 400. Here, the degradation map MAP may be a numerical value map in which a coordinate of each pixel included in the display panel 100 and the degradation data Ddata are mapped to each other.

The degraded region detection unit 510 detects a degraded region with reference to the degradation data Ddata corresponding to each pixel included in the display panel 100.

Here, the degraded region may be a region including pixels where luminance between the pixels adjacent to each other is abruptly varied.

A meaning of the degraded region detected by the degraded region detection unit 510 will be described with reference to FIG. 7.

Figure 7:
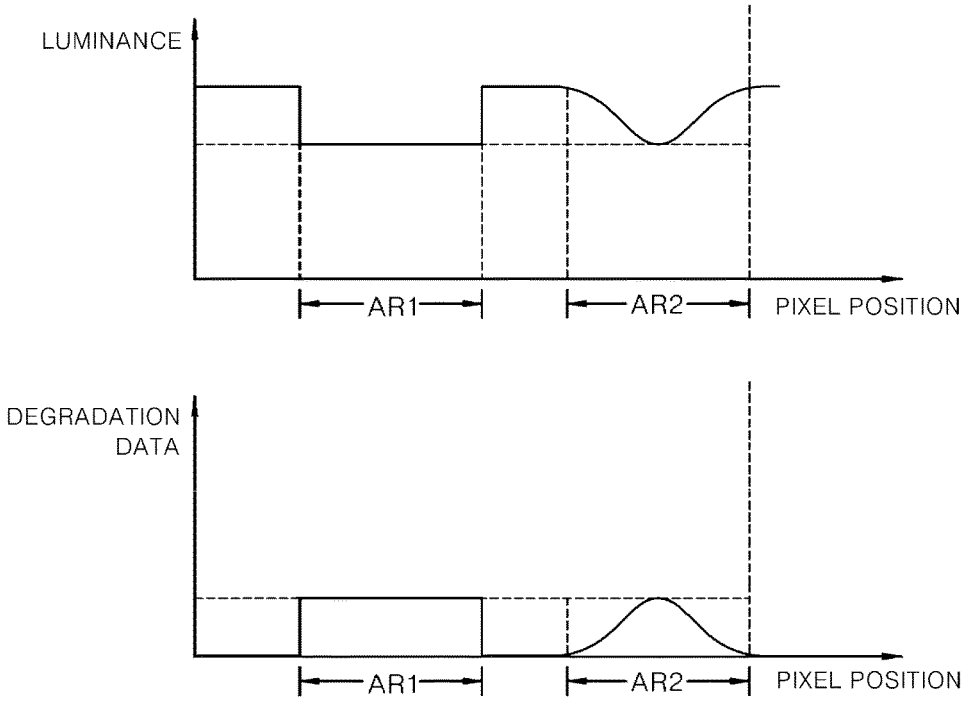
FIG. 7 is a graph illustrating luminance and degradation data of pixel sections having different degradation forms from each other.

FIG. 7 is a graph illustrating luminance and degradation data of each of pixel sections having different degradation forms from each other.

Referring to FIG. 7, both of a pixel section of a region AR1 and a pixel section of a region AR2 respectively have maximum luminance of L4 and minimum luminance of L3 so that the maximum luminance and the minimum luminance are the same. However, the luminance at each of both ends of the region AR1 is abruptly varied, whereas the luminance at each of both ends of the region AR2 is gradually increased and decreased.

A user perceives only the pixel section of the region AR1 in which luminance is abruptly varied at both ends thereof, as image sticking of the regions AR1 and AR2 having the same maximum and minimum luminance. That is, when a luminance deviation between adjacent pixels is large, a corresponding region is easily perceived as image sticking by the user. In other words, when a variance of luminance is gradual while a luminance difference between maximum and minimum luminance of a specific pixel section is large, it may be difficult for the user to perceive image sticking.

Such a variance of luminance in a pixel is in proportion to degradation data of the pixel.

As described above herein, the degradation data is a numerical value representing a degree of degradation of a pixel and may be sensing data that is sensed at each pixel or a cumulative amount of data per each pixel.

Therefore, a difference of degradation data between adjacent pixels is calculated based on the degradation data of pixels shown in FIG. 7 such that a pixel section, which is easily perceived as image sticking by the user, may be determined.

Consequently, the degraded region detection unit 510 detects a degraded region with reference to the degradation data corresponding to each pixel included in a display panel.

Referring back to FIG. 6, the degraded region detection unit 510 will be described in detail.

The degraded region detection unit 510 according to one embodiment determines whether each pixel is a degraded pixel with reference to the degradation data Ddata.

To do so, the degraded region detection unit 510 applies a detection mask to degradation data Ddata of pixels included in a preset detection region. Further, the degraded region detection unit 510 calculates a degradation deviation value from the degradation data Ddata to which the detection mask is applied, and detects a degraded region based on the calculated degradation deviation value.

Here, the detection mask may be a structure of an arbitrary matrix form located on the degradation map. For example, the detection mask may be a square matrix form such as 3×3, 5×5, and 7×7, but it is not limited thereto. The detection mask may be one among a prewitt mask, a sobel mask, a Roberts mask, and a Laplacian mask, but it is not limited thereto.

The degraded region detection unit 510 places the detection mask on the degradation map and operations each operator of the detection mask with degradation data Ddata, which corresponds to a position of each operator, on the degradation map to calculate a degradation deviation value. When the degradation deviation value is equal to or greater than a degradation deviation reference value, the degraded region detection unit 510 determines a pixel, which is located at a center of the detection mask, as a degraded pixel. Here, the degradation deviation reference value, which is preset, may be a numerical value of criterion in determining whether a difference between degradation data of the pixel located at the center of the detection mask and a pixel adjacent to the pixel located at the center thereof is perceived as image sticking by the user.

The degraded region detection unit 510 determines whether a degraded pixel exists with respect to all pixels on the display panel 100 by moving the detection mask in a row direction and a column direction.

In case that the pixel determined to a degraded pixel is adjacent, the degraded region detection unit 510 determines the adjacent degraded pixel as a degraded region when the adjacent degraded pixel has a value equal to or greater than a preset degraded region reference value.

FIG. 8 is a diagram for describing a degraded region detection of a degraded region detection unit 510 according to one embodiment.

Referring to FIG. 8, the degraded region detection unit 510 may use an X-axis sobel mask and a Y-axis sobel mask as a detection mask, and it may calculate a degradation deviation value using the following Equation 1 when detecting a degraded region by setting a degradation deviation reference value and a degraded region reference value to 20 and 10, respectively.

[Equation 1]

$$Eh = \sum_{i,j=-1}^{i,j=1} I(i, j) \times Sobelh(i, j)$$

$$Ev = \sum_{i,j=-1}^{i,j=1} I(i, j) \times Sobelv(i, j)$$

$$SI = \frac{(|Eh| + |Ev|)}{TP}$$

Here, I(i, j) is degradation data of a pixel, Sobelh(i, j) is an operator of the X-axis sobel mask, Eh is an operation value of the X-axis sobel mask, Sobelv(i, j) is an operator of the Y-axis sobel mask, Ev is an operation value of the Y-axis sobel mask, TP is the number of pixels of a sobel mask, and SI is a degradation deviation value of a pixel located at a center of the sobel mask.

The degraded region detection unit 510 calculates a degradation deviation value by applying the sobel mask to degradation data of a pixel located at (2, 2), multiplies operators (1, 0, −1), (1, 0, −1), and (1, 0, −1) of the X-axis sobel mask and degradation data (10, 10, 10), (10, 10, 10), and (10, 10, 10) of pixels corresponding to a position of the X-axis sobel mask, and sums up the multiplication results, thereby calculating an operation value of the X-axis sobel mask as 0.

Thereafter, the degraded region detection unit 510 multiplies operators (1, 1, 1), (0, 0, 0), and (−1, −1, −1) of the Y-axis sobel mask and degradation data (10, 10, 10), (10, 10, 10), and (10, 10, 10) of pixels corresponding to a position of the Y-axis sobel mask, and sums up the multiplication results, thereby calculating an operation value of Y-axis sobel mask as 0.

The degraded region detection unit 510 divides a sum of an absolute value of the operation value of the X-axis sobel mask and an absolute value of the operation value of the Y-axis sobel mask by 9 of the number of pixels of the sobel mask, thereby calculating a degradation deviation value of the pixel located at (2, 2) as 0.

Since the degradation deviation value (that is, 0) of the pixel located at (2, 2) is not equal to or greater than 20 that is a degradation deviation reference value, the degraded region detection unit 510 does not determine the pixel located at (2, 2) as a degraded pixel.

Afterward, the degraded region detection unit 510 determines whether the pixel located at (2, 2) is a degraded pixel using the X-axis sobel mask and the Y-axis sobel mask, and moves the X-axis sobel mask and the Y-axis sobel mask to an X-axis and a Y-axis, respectively, thereby determining whether a degraded pixel exists with respect to all pixels.

FIG. 9 is a diagram illustrating a degraded region detected from the degraded region detection unit 510 according to one embodiment.

Referring to FIG. 9, like FIG. 8, the degraded region detection unit 510 performs a process of determining whether a degraded pixel exists with respect to all pixels, thereby detecting pixels located at (3, 3 to 7), (4, 3 to 7), (5, 3), (5, 4), (5, 6), (5, 7), (6, 3 to 7), and (7, 3 to 7) as degraded pixels.

Thereafter, since the number of adjacent degraded pixels, that is, 24 exceeds a preset degraded region reference value, that is, 10, the degraded region detection unit 510 determines the adjacent degraded pixels as a degraded region AR1.

At this point, when a pixel, which is not a degraded pixel and is, for example, located at (5, 5), is surrounded by the degraded pixels, the degraded region detection unit 510 may determine that the corresponding pixel is also included in the degraded region AR1.

On the other hand, a conventional degraded region detection method detects a certain region, which is presumed to output a logo such as a specific character, a number, and a symbol for a long time, as a degraded region so that a degraded region is detected without reflecting an actual degradation degree of a pixel.

However, the degraded region detection unit 510 according to one embodiment of the present disclosure detects a degraded region with reference to degradation data of each of all pixels included in the display panel 110 so that a degraded region may be detected by accurately reflecting a degradation degree of each of all the pixels.

Referring to FIG. 7, the image characteristic constant generation unit 520 generates an image characteristic constant, which represents a characteristic of an image that is to be displayed on the display panel 100, from the input image data DATA. More particularly, the image characteristic constant generation unit 520 analyzes the input image data DATA to generate the image characteristic constant.

Here, the image characteristic constant includes one or more of a global motion constant f1, a local motion constant f2, a local average pixel level constant f3, a local chroma constant f4, and a local edge constant f5.

In the present embodiment, the global motion constant f1 is a constant with respect to a motion generated in an image due to a movement of a camera while the image is taken. The local motion constant f2 is a constant with respect to a motion generated in an image due to a movement of an object in the image. The local average pixel level constant f3 is a constant with respect to an average brightness obtained from some region of an image. The local chroma constant f4 is a constant with respect to chroma obtained from some region of an image. Lastly, the local edge constant f5 is a constant with respect to sharpness obtained from resolution of an edge region of an image.

The above described image characteristic constant may be a constant that is used in the compensation data correction unit 540 for determining whether to correct compensation data. This will be described in detail below.

Hereinafter, when a degraded region is determined using the above described method, a process of correcting compensation data through the pixel compensation module 500 will be described in detail with reference to FIGS. 7 and 10.

Figure 10:
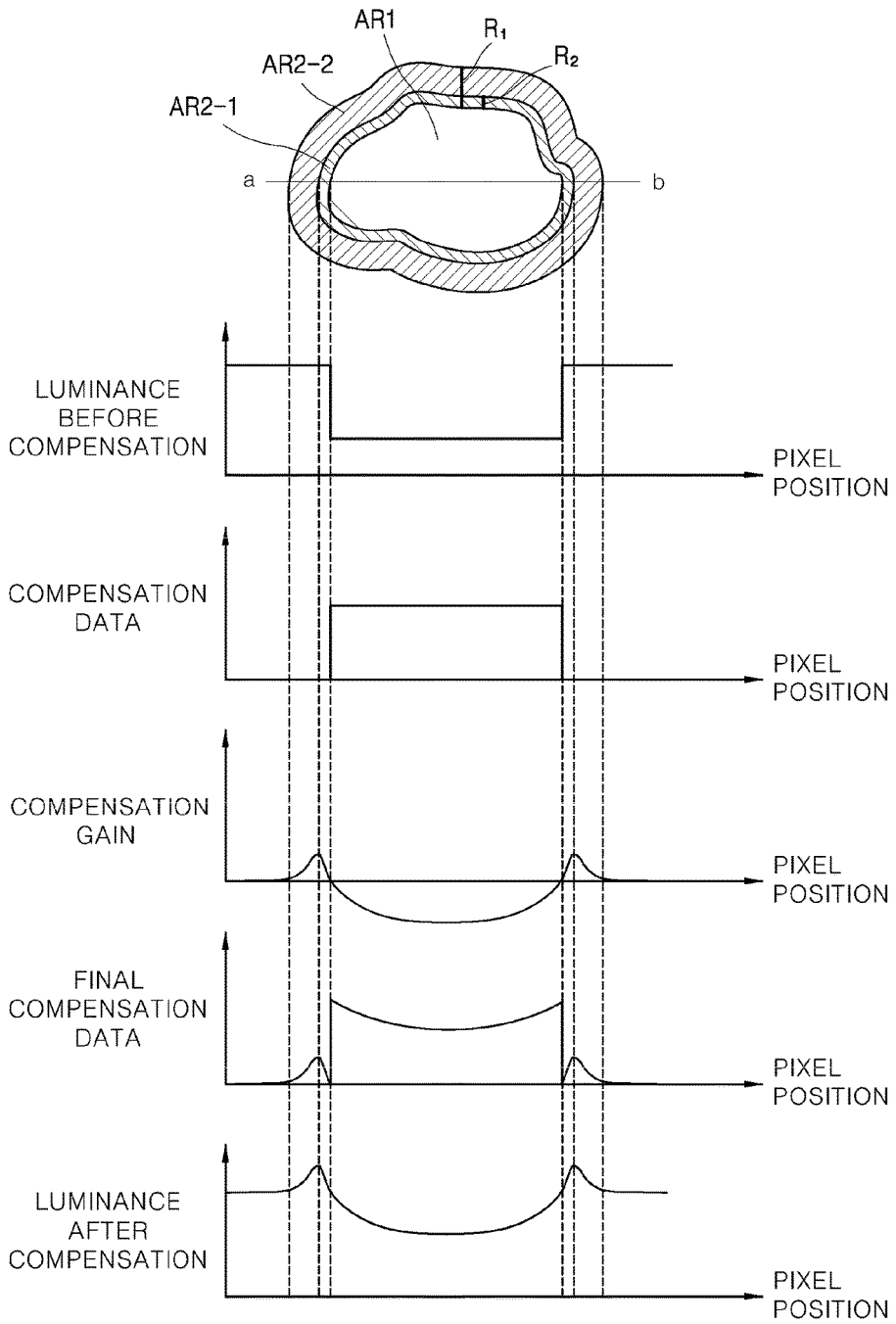
FIG. 10 is a diagram illustrating luminance, compensation data, and a compensation gain according to a degraded region and a adjacent degraded region.

FIG. 10 is a diagram illustrating luminance, compensation data, and a compensation gain according to a degraded region AR1 and an adjacent degraded region AR2.

Referring to FIG. 10, the pixel compensation module 500 according to one embodiment of the present disclosure sets a region within a first preset distance $R_1$ from a peripheral pixel of the degraded region AR1 as the adjacent degraded region AR2.

Also, the pixel compensation module 500 sets a region within a second preset distance $R_2$ from a peripheral pixel of the degraded region AR1 as a first adjacent degraded region AR2-1.

The pixel compensation module 500 sets a region between a peripheral pixel of the first adjacent degraded region AR2-1 and a peripheral pixel of the adjacent degraded region AR2 as a second adjacent degraded region AR2-2.

That is, when the degraded region AR1 is detected by means of the degraded region detection unit 510, the first adjacent degraded region AR2-1 enclosing the surroundings of the degraded region AR1 with a width of the second preset distance $R_2$ is set, and the second adjacent degraded region AR2-2 having a width of a difference between the first preset distance $R_1$ and the second preset distance $R_2$ is set to enclose the first adjacent degraded region AR2-1.

The compensation gain determination unit 530 determines a first compensation gain G1 for correcting compensation data Cdata of pixels included in the degraded region AR1, and a second compensation gain G2 for correcting compensation data Cdata of pixels included in the adjacent degraded region AR2.

More particularly, the compensation gain determination unit 530 determines the first compensation gain G1 so as to decrease a size of final compensation data Cdata' as moving from the peripheral pixel of the degraded region AR1 to a central pixel CP thereof.

That is, the compensation gain determination unit 530 determines the first compensation gain G1 so as to make a size of final compensation data Cdata' of the peripheral pixel of the degraded region AR1 have a maximum value among sizes of final compensation data Cdata' of the pixels included in the degraded region AR1.

Also, the compensation gain determination unit 530 determines the first compensation gain G1 so as to make a size of final compensation data Cdata' of the central pixel CP of the degraded region AR1 have a minimum value among the sizes of final compensation data Cdata' of the pixels included in the degraded region AR1.

Meanwhile, the compensation gain determination unit 530 determines the second compensation gain G2 so as to increase sizes of final compensation data Cdata' of pixels included in the first adjacent degraded region AR2-1 as moving the peripheral pixel of the degraded region AR1 to the peripheral pixel of the first adjacent degraded region AR2-1.

In addition, the compensation gain determination unit 530 determines the second compensation gain G2 so as to decrease sizes of final compensation data Cdata' of pixels included in the second adjacent degraded region AR2-2 as moving from the peripheral pixel of the first adjacent degraded region AR2-1 to the peripheral pixel of the second adjacent degraded region AR2-2.

Alternatively, the minimum value of the final compensation data Cdata' of the pixels included in the degraded region AR1 and the maximum value of the final compensation data Cdata' of the pixels included in the adjacent degraded region AR2 may be preset by means of the compensation gain determination unit 530.

In one embodiment of the present disclosure, the compensation gain determination unit 530 adjusts the minimum value of the final compensation data Cdata' of the pixels included in the degraded region AR1 and the maximum value of the final compensation data Cdata' of the pixels included in the adjacent degraded region AR2 on the basis of a variance amount of the image characteristic constant.

For example, the compensation gain determination unit 530 adjusts the minimum value of final compensation data Cdata' of the pixels included in the degraded region AR1 or the maximum value of the final compensation data Cdata' of the pixels included in the adjacent degraded region AR2 in proportion to a variance amount of one or more of the global motion constant f1, the local motion constant f2, the local average pixel level constant f3, the local chroma constant f4, and the local edge constant f5 included in the image characteristic constant.

For example, when the local chroma constant f4 is increased, the compensation gain determination unit 530 may increase the minimum value of final compensation data Cdata' of the pixels included in the degraded region AR1 or the maximum value of the final compensation data Cdata' of the pixels included in the adjacent degraded region AR2.

As another example, when a value obtained by adding the local average pixel level constant f3 to the local chroma constant f4 or by multiplying the local average pixel level constant f3 by the local chroma constant f4 is increased, the compensation gain determination unit 530 may increase the minimum value of final compensation data Cdata' of the pixels included in the degraded region AR1 or the maximum value of the final compensation data Cdata' of the pixels included in the adjacent degraded region AR2 according to the increase of the added or multiplied value.

Here, due to an increase of compensation data as sizes of the global motion constant f1, the local motion constant f2, the local average pixel level constant f3, the local chroma constant f4, and the local edge constant f5 are increased, perceptual ability of the user is lower even when a variance range of one or more of luminance of a pixel and chroma of an image is increased.

For example, since a large amount of movement exists on an image when the global motion constant f1 is higher, the user may not perceive an increase of one or more of luminance of a pixel and chroma of the image even when compensation data is increased to cause an increase of one or more of the luminance of the pixel and the chroma of the image.

Therefore, when the sizes of the global motion constant f1, the local motion constant f2, the local average pixel level constant f3, the local chroma constant f4, and the local edge constant f5 are increased, the compensation gain determination unit 530 adjusts and increases the minimum value of final compensation data Cdata' of the pixels included in the degraded region AR1 or the maximum value of the final compensation data Cdata' of the pixels included in the adjacent degraded region AR2.

Comparing luminance before and after the compensation at each of the regions, the luminance of the pixels included in the degraded region AR1 before the compensation is abruptly decreased and increased at a boundary between the degraded region AR1 and the first adjacent degraded region AR2-1. On the other hand, the luminance of the pixels included in the degraded region AR1 after the compensation is gradually decreased at the boundary between the degraded region AR1 and the first adjacent degraded region AR2-1. Also, even within the degraded region AR1, the size of the compensation data becomes small as moving toward the central pixel CP rather than the compensation of a uniform size is applied as in the conventional method.

Further, the luminance of the pixels included in the adjacent degraded region AR2 after the compensation is gradually increased toward a maximum value as moving from the peripheral pixel of the degraded region AR1 to the peripheral pixel of the first adjacent degraded region AR2-1, and then is gradually decreased as moving from the peripheral pixel of the first adjacent degraded region AR2-1 to the peripheral pixel of the second adjacent degraded region AR2-2.

As a result, when such compensation is performed, the boundary of the degraded region AR1 is blurred compared to that before the compensation so that it is difficult for the user to perceive the degraded region AR1 as degradation of an actual panel. Also, the size of the compensation data applied to the degraded region AR1 is smaller compared to the conventional method, leading to a slower degradation of the degraded region AR1.

Meanwhile, when the degradation data Ddata of the pixels included in the degraded region AR1 is equal to or greater than a preset compensation reference value, the compensation gain determination unit 530 according to another embodiment of the present disclosure determines the first compensation gain G1 of the pixels included in the degraded region AR1 as 0.

In other words, according to another embodiment of the present disclosure, compensation for only the adjacent degraded region AR2 may be performed instead of compensating for the degraded region AR1 when a degradation degree of the pixels included in the degraded region AR1 is less than a degradation degree according to the preset compensation reference value.

In accordance with the related art, when compensation for the degraded region AR1 is not performed even though the degradation degree of the pixels included in the degraded region AR1 is less than the degradation degree according to the preset compensation reference value, the degraded region AR1 may be perceived as a degraded region of the panel by the user. However, in accordance with an embodiment of the present disclosure, the compensation for the adjacent degraded region AR2 is performed, which is not performed in the conventional method, so that it is difficult for the user to perceive the degraded region AR1 as the degraded region of the panel even when compensation for the degraded region AR1 is not performed.

Referring back to FIGS. 7 and 10, the compensation data correction unit 540 corrects compensation data Cdata of the pixels included in the degraded region AR1 and compensation data Cdata of the pixels included in the adjacent degraded region AR2 using the first compensation gain G1 and the second compensation gain G2.

Before performing a correction for the compensation data Cdata, the compensation data correction unit 540 determines whether to correct the compensation data Cdata of the pixels included in the degraded region AR1 or the compensation data Cdata of the pixels included in the adjacent degraded region AR2 on the basis of the input image data. That is, the compensation data correction unit 540 determines whether the input image data is suitable for performing the compensation on the basis of the image characteristic constant. At this point, as described above, the image characteristic constant includes one or more of the global motion constant f1, the local motion constant f2, the local average pixel level constant f3, the local chroma constant f4, and the local edge constant f5.

For example, the compensation data correction unit 540 multiplies all the global motion constant f1, the local motion constant f2, the local average pixel level constant f3, the local chroma constant f4, and the local edge constant f5 with each other, and then compares the multiplication result with a preset correction determination reference value.

When the multiplication result exceeds the preset correction determination reference value as the determination result, the compensation data correction unit 540 determines to correct the compensation data Cdata of the pixels included in the degraded region AR1 and the compensation data Cdata of the pixels included in the adjacent degraded region AR2.

On the other hand, when the multiplication result is equal to or less than the preset correction determination reference value as the determination result, the compensation data correction unit 540 determines not to correct the compensation data Cdata of the pixels included in the degraded region AR1 and the compensation data Cdata of the pixels included in the adjacent degraded region AR2.

Through such a process, the compensation data correction unit 540 performs a correction of the compensation data with respect to only an image having an image characteristic that is difficult to be perceived by the user even though luminance and chroma of a pixel are varied so that a correction of the compensation data may be efficiently performed by corresponding to an image characteristic.

Figure 11:
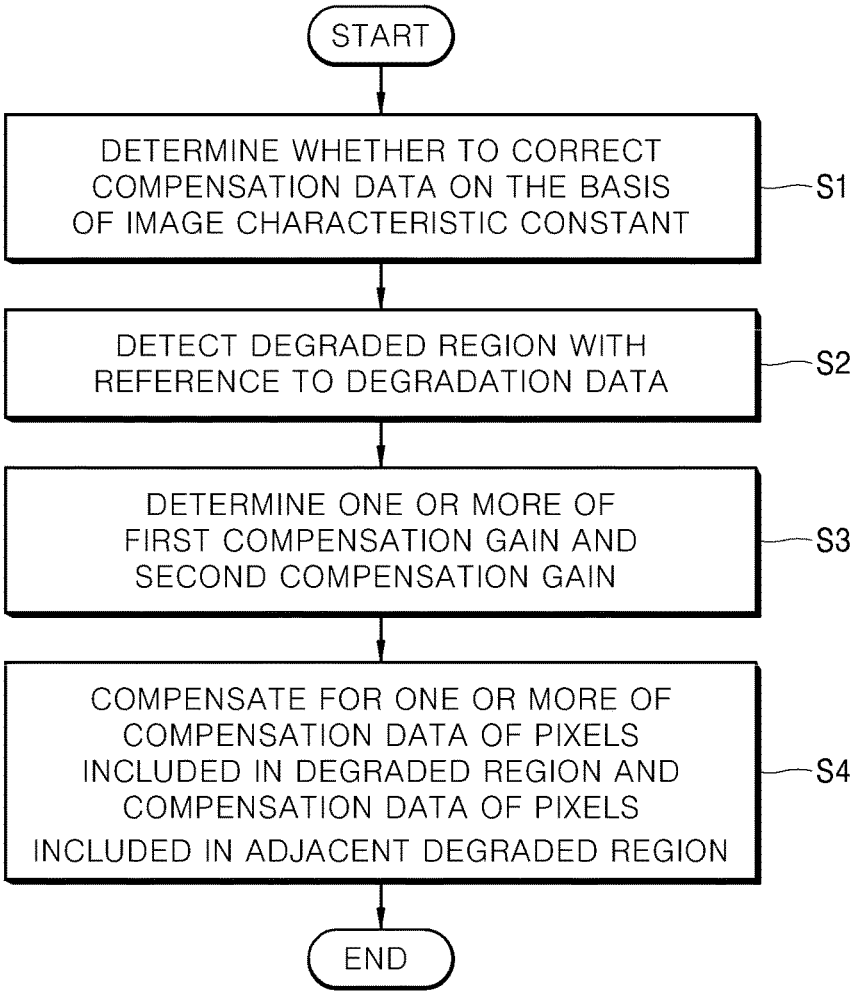
FIG. 11 is a flow chart illustrating a sequence of a pixel compensation method according to one embodiment of the present disclosure.

FIG. 11 is a flow chart illustrating a sequence of a pixel compensation method according to one embodiment of the present disclosure.

Referring to FIG. 11, whether correction for compensation data is performed is determined on the basis of an image characteristic constant and whether input image data is suitable for performing compensation in Operation S1. In Operation 51, when it is determined not to correct the compensation data because the input image data is not suitable for performing the compensation, whether the correction for the compensation data is periodically determined on the basis of the image characteristic constant.

When it is determined to correct the compensation data because the input image data is suitable for performing the compensation in Operation S1, a degraded region is detected with reference to degradation data corresponding to each pixel included in a display panel in Operation S2.

To describe Operation S2 in more detail, whether each pixel is a degraded pixel is determined with reference to the degradation data, and, when the number of adjacent degraded pixels is equal to or greater than a preset degraded region reference value, a region including the adjacent degraded pixels is determined as a degraded region.

Next, a first compensation gain for correcting compensation data of pixels included in the degraded region, and a second compensation gain for correcting compensation data of pixels included in an adjacent degraded region are determined in Operation S3.

To describe Operation S3 in more detail, the first compensation gain is determined so as to decrease sizes of final compensation data of the pixels included in the degraded region as moving from a peripheral pixel of the degraded region to a central pixel thereof.

Consequently, a size of final compensation data of the peripheral pixel of the degraded region may be a maximum value among the sizes of final compensation data of the pixels included in the degraded region.

Also, a size of final compensation data of the central pixel of the degraded region may be a minimum value among the sizes of final compensation data of the pixels included in the degraded region.

Meanwhile, the second compensation gain is determined so as to increase sizes of final compensation data of pixels included in a first adjacent degraded region as moving from the peripheral pixel of the degraded region to a peripheral pixel of the first adjacent degraded region.

Also, the second compensation gain is determined so as to decrease sizes of final compensation data of pixels included in a second adjacent degraded region as moving from the peripheral pixel of the first adjacent degraded region to a peripheral pixel of the second adjacent degraded region.

At this point, a minimum value of the final compensation data of the pixels included in the degraded region or a maximum value of the final compensation data of the pixels included in the adjacent degraded region may be determined on the basis of an image characteristic constant.

In Operation S4, the compensation data of the pixels included in the degraded region, and the compensation data of the pixels included in the adjacent degraded region are corrected using the first compensation gain and the second compensation gain which are determined in Operation S3.

As described above, in accordance with a pixel compensation method according to an embodiment of the present disclosure, the final compensation data of the pixels included in the degraded region is decreased and the final compensation data of the pixels included in the adjacent degraded region is increased so that a lowering of image quality due to degradation may be reduced or prevented, and also a degradation degree of the pixels included in the degraded region may be decreased, thereby extending the lifetime of a display device.

The present disclosure described above may be variously substituted, altered, and modified by those skilled in the art to which the present invention pertains without departing from the scope and sprit of the present disclosure. Therefore, the present disclosure is not limited to the above-mentioned exemplary embodiments and the accompanying drawings.

What is claimed is:

1. A display device comprising:

a display panel having a plurality of pixels;

a driver that drives the plurality of pixels;

a pixel compensation circuit that compensates input image data and provides compensated input image data to the driver, the pixel compensation circuit including:

a degraded region detection unit that detects a degraded region with reference to degradation data corresponding to each of the pixels included in the display panel;

a compensation gain determination unit that determines a first compensation gain for correcting compensation data of pixels included in the degraded region, and a second compensation gain for correcting compensation data of pixels included in an adjacent degraded region within a first preset distance from a peripheral pixel of the degraded region; and a compensation data correction unit that corrects the compensation data of the pixels included in the degraded region and the compensation data of the pixels included in an adjacent degraded region using the first compensation gain and the second compensation gain, wherein the adjacent degraded region includes a first adjacent degraded region within a second preset distance from the peripheral pixel of the degraded region, and a second adjacent degraded region between a peripheral pixel of the first adjacent degraded region and a peripheral pixel of the adjacent degraded region, and wherein the compensation gain determination unit determines the second compensation gain so as to increase sizes of final compensation data of pixels included in the first adjacent degraded region as moving from the peripheral pixel of the degraded region to a peripheral pixel of the first adjacent degraded region, and the second compensation gain so as to decrease sizes of final compensation data of pixels included in the second adjacent degraded region as moving from a peripheral pixel of the first adjacent degraded region to a peripheral pixel of the second adjacent degraded region.

2. The display device of claim 1, wherein the degraded region detection unit calculates a degradation deviation value by applying a detection mask to degradation data of pixels included in a preset detection region, and detects the degraded region on the basis of the degradation deviation value.

3. The display device of claim 1, wherein the compensation gain determination unit determines the first compensation gain so as to decrease sizes of final compensation data of pixels included in the degraded region as moving from the peripheral pixel of the degraded region to a central pixel thereof.

4. The display device of claim 1, wherein the compensation data correction unit determines whether to correct the compensation data of the pixels included in the degraded region or the compensation data of the pixels included in the adjacent degraded region on the basis of an image characteristic constant generated from the input image data.

5. The display device of claim 1, wherein the compensation gain determination unit adjusts a minimum value of the final compensation data of the pixels included in the degraded region or a maximum value of the final compensation data of the pixels included in the adjacent degraded region on the basis of an image characteristic constant generated from the input image data.

6. The display device of claim 1, wherein the compensation gain determination unit determines the first compensation gain for the pixels as 0 when the degradation data of the pixels included in the degraded region is equal to or greater than a preset compensation reference value.

7. The display device of claim 1, wherein the driver includes a timing controller and a data driver.

8. The display device of claim 7, wherein the pixel compensation circuit provides the compensated input image data to the timing controller, and wherein the timing controller further modulates the compensated input image data before sending it to the data driver.

9. A pixel compensation method for correcting compensation data assigned to pixels, comprising:

detecting a degraded region with reference to degradation data corresponding to each of pixels included in a display panel;

determining one or more of a first compensation gain for correcting compensation data of pixels included in the degraded region, and a second compensation gain for correcting compensation data of pixels included in an adjacent degraded region within a first preset distance from a peripheral pixel of the degraded region; and correcting one or more of the compensation data of the pixels included in the degraded region and the compensation data of the pixels included in an adjacent degraded region using one or more of the first compensation gain and the second compensation gain, wherein the adjacent degraded region includes a first adjacent degraded region within a second preset distance from the peripheral pixel of the degraded region, and a second adjacent degraded region between a peripheral pixel of the first adjacent degraded region and a peripheral pixel of the adjacent degraded region, the determining includes:

determining the second compensation gain so as to increase sizes of final compensation data of pixels included in the first adjacent degraded region as moving from the peripheral pixel of the degraded region to a peripheral pixel of the first adjacent degraded region; and determining the second compensation gain so as to decrease sizes of final compensation data of pixels included in the second adjacent degraded region as moving from a peripheral pixel of the first adjacent degraded region to a peripheral pixel of the second adjacent degraded region.

10. The pixel compensation method of claim 9, wherein the detecting includes:

determining whether each of the pixels is a degraded pixel with reference to the degradation data; and determining, when the number of adjacent degraded pixels is equal to or greater than a preset degraded region reference value, a region including the adjacent degraded pixels as the degraded region.

11. The pixel compensation method of claim 9, wherein the detecting includes determining the first compensation gain so as to decrease sizes of final compensation data of the pixels included in the degraded region as moving from the peripheral pixel of the degraded region to a central pixel thereof.

12. The pixel compensation method of claim 9, wherein the determining includes adjusting a minimum value of the final compensation data of the pixels included in the degraded region or a maximum value of the final compensation data of the pixels included in the adjacent degraded region on the basis of an image characteristic constant generated from input image data.

13. The pixel compensation method of claim 9, wherein the determining includes determining the first compensation gain for the pixels as 0 when the degradation data of the pixels included in the degraded region is equal to or greater than a preset compensation reference value.

14. A display device comprising:

a display panel having a plurality of pixels;

a driver that drives the plurality of pixels;

a pixel compensation circuit that compensates input image data and provides compensated input image data to the driver, the pixel compensation circuit including:

a degraded region detection unit that detects a degraded region with reference to degradation data corresponding to each of the pixels included in the display panel;

a compensation gain determination unit that determines a first compensation gain for correcting compensation data of pixels included in the degraded region, and a second compensation gain for correcting compensation data of pixels included in an adjacent degraded region within a first preset distance from a peripheral pixel of the degraded region; and a compensation data correction unit that corrects the compensation data of the pixels included in the degraded region and the compensation data of the pixels included in an adjacent degraded region using the first compensation gain and the second compensation gain, wherein the degraded region detection unit determines whether each of the pixels is a degraded pixel with reference to the degradation data, and, when the number of adjacent degraded pixels is equal to or greater than a preset degraded region reference value, determines a region including the adjacent degraded pixels as the degraded region.

* * * * *